US005509171A

United States Patent [19]

Zejda

[11] Patent Number: 5,509,171

[45] Date of Patent: Apr. 23, 1996

[54] VACUUM CLEANER BUMPER SYSTEM

[76] Inventor: Frantisek Zejda, 4767 N. Waterfront Way, Boise, Id. 83703

[21] Appl. No.: 350,903

[22] Filed: Dec. 7, 1994

[51] Int. Cl.[6] ..... A47L 9/00

[52] U.S. Cl. ..... 15/325; 15/45

[58] Field of Search ..... 15/325, 45

[56] References Cited

U.S. PATENT DOCUMENTS

| | | | |
|---|---|---|---|
| 471,086 | 3/1892 | Raymond | 15/45 X |
| 1,935,158 | 11/1933 | Lumley | 15/325 X |
| 2,324,111 | 7/1943 | Ross | 15/325 X |
| 2,969,557 | 1/1961 | Petersen | 15/325 X |

*Primary Examiner*—Chris K. Moore

*Attorney, Agent, or Firm*—Ken J. Pedersen; Barbara S. Pedersen

[57] ABSTRACT

Embodiments of a bumper system are shown and described, each being for installation on floor maintenance equipment to prevent damage to walls, furniture, and woodwork, and to make easier and smoother the movement of the equipment around such obstacles. Each bumper system includes a bumper member that may resiliently retract to cushion head-on impacts and to allow the equipment to reach close to the edge of the floor or carpet. Secondly, the bumper member may rotate or pivot, so that, during a side-impact, the bumper member urges or pivots the equipment away from and around the obstacle. Thirdly, the bumper member has a rolling function, so that the bumper member may roll along a wall or obstacle surface. Preferred embodiments include a pie-piece-shaped or circle-sector-shaped member pivotally attached to the equipment head, with the arc-edge of the sector member facing out toward the corner and side of the equipment head, and having a roller connected to the front edge of the sector. Another embodiment includes a horizontally-disposed wheel that is biased and retained so that it can retract during a head-on impact and so that it rotates but does not retract during a side-impact.

11 Claims, 5 Drawing Sheets

VACUUM CLEANER BUMPER SYSTEM

BACKGROUND OF THE INVENTION

1. Field of the Invention

This invention relates generally to vacuum cleaners, and, more specifically, to vacuum cleaner bumper systems for preventing damage to walls, woodwork, and furniture.

2. Related Art

Two goals of vacuum cleaner design have been to provide a vacuum cleaner head that can be moved close to a wall or other obstacle to clean close to the carpet or floor edge but also a vacuum cleaner head that minimizes damage to walls, woodwork, and furniture. Traditional vacuum cleaners, both of canister and upright styles, steam cleaners, waxers, and shampooers often tend to gouge, scrape, or chip the surfaces against which they are pushed. The damage typically occurs because of a combination of the weight of the vacuum head, the hard materials typical of vacuum heads, or the enthusiasm or haste of the user.

The woodwork around doors, corners, and stair steps is especially vulnerable to damage. The woodwork sticks out into the path of the vacuum head and the user is usually trying to wedge the vacuum head along a wall or into a small space to pick up dirt or lay down wax, for example. Even when rubber or plastic bumpers are attached to the perimeter edge of a vacuum head, woodwork surfaces are still frequently marked, marred, or chipped.

Several U.S. Patents disclose designs that attempt to alleviate this damage problem. Moorhead (U.S. Pat. No. 927,668) discloses horizontally disposed rubber disks which extend beyond the periphery of a sweeper casing. Rosenbery (U.S. Pat. No. 1,923,689) discloses bumper wheels on both sides of a suction machine. Gambardella (U.S. Pat. No. 2,222,835) discloses a rubber bumper that moves on balls in a track on the outer wall of a floor scrubbing and polishing machine. Sakurai, et al (U.S. Pat. No. 5,214,822 and 5,134,749) discloses a loop-shaped bumper that is angularly movable around a group of rollers in a "caterpillar" construction. The Sakurai, et al bumper extends in a semi-circle around the front of a vacuum cleaner canister. Sakurai, et al also discloses a swinging plate, or a set of two swinging plates, that extends across the width of the cleaner canister. Each swinging plate can pivot slightly to the side.

What is needed is an improved bumper system, for vacuum cleaners and other floor maintenance equipment, that effectively cushions and yet allows the cleaner head to reach close to a wall or obstacle. What is needed is a bumper system that is inexpensive and that can be installed on a wide variety of equipment.

SUMMARY OF THE INVENTION

An object of the present invention is to provide a bumper system, for a vacuum cleaner or other floor maintenance equipment, that cushions the blow of the vacuum cleaner against a wall, woodwork, furniture, or other obstacles. Another object is to provide a bumper system that allows the vacuum cleaner head to reach close to edges or corners of floors or carpets for thorough cleaning. A third object is to provide a bumper system that makes easier and smoother the movement of the vacuum cleaner head as the user maneuvers it around woodwork or obstacles.

The present invention comprises a bumper system for installation on various types of floor maintenance equipment heads that are used for cleaning, waxing, polishing, sanding, shampooing, etc., of floors or other surfaces. Optionally, the bumper system may be installed on the canisters of vacuum cleaners or shampooers, for example.

The various embodiments of the bumper system comprise three features:

1. a retracting feature that allows the bumper to move out of the way when it hits a wall or obstacle head-on, in such a way that the blow to the wall or obstacle is cushioned but also that the vacuum head can move close to the wall or obstacle;
2. a pivot or rotating feature that eases movement of the vacuum head around woodwork or obstacle; and
3. a rolling feature that eases movement of the vacuum head along a wall or obstacle surface.

These three features or functions combine to create a bumper system that prevents damage and eases the movements and effort involved in vacuuming, shampooing, etc..

The bumper system comprises a bumper member connected to the in such a way that the bumper member extends generally horizontally out from the horizontal extent, that is, the horizontally-outermost portion, of the equipment head, and in such a way that the bumper member resiliently retracts retracts into the equipment head when the bumper member hits an obstacle "head-on", that is, straight on and contacting the front-most or forward-most part of the bumper member. Also, the bumper member rotates or pivots to the side when the bumper member hits an obstacle on the bumper member's side, thus easing the equipment head around the obstacle. Also, the bumper member includes a wheel or other roller that rolls along the surface of the obstacle when the bumper member contacts the obstacle.

The preferred embodiment includes a bumper member that comprises a circle sector pivotally connected at its point to the equipment head. The sector is spring-loaded so that it resiliently pivots out of the way, thus "hiding into the head", when it hits an obstacle head-on. When the sector hits an obstacle to one side, thus, putting the arc edge of the sector in contact with the obstacle, the sector pivots to urge the equipment head to the side, away from and around the obstacle. The bumper member also includes a roller connected to its outer front side for rolling along an obstacle surface.

An alternative embodiment of the bumper member is a circular member rotatably connected to the equipment head and spring-loaded in such a way that it resiliently retracts out of the way, thus "hiding into the head", when it hits an obstacle head-on. When the circular member hits an obstacle to one side, rather than retracting, the circular member rotates to urge the equipment head to the side, away from and around the obstacle. The circular member also acts as a roller for rolling along an obstacle surface.

Optionally, the bumper members may include cushioning material to provides additional protection against damage, but the bumper members should be firm enough that, when hit on the side, the bumper members transfer force to the equipment head to tend to move the equipment head to the side away from the obstacle.

DETAILED DESCRIPTION OF THE PREFERRED EMBODIMENT

Referring to FIGS. 1–5, there are shown two, but not the only, embodiments of the invented bumper system 10, 40. The preferred embodiment, illustrated in FIGS. 1 to 4, includes a bumper member that comprises a circle-sector-shaped member pivotally connected at or near its pointed end to the equipment head. The alternative embodiment, shown in FIGS. 5A–C is a circular member rotatably connected to the equipment head.

Circle-Sector Design

Figure 1:
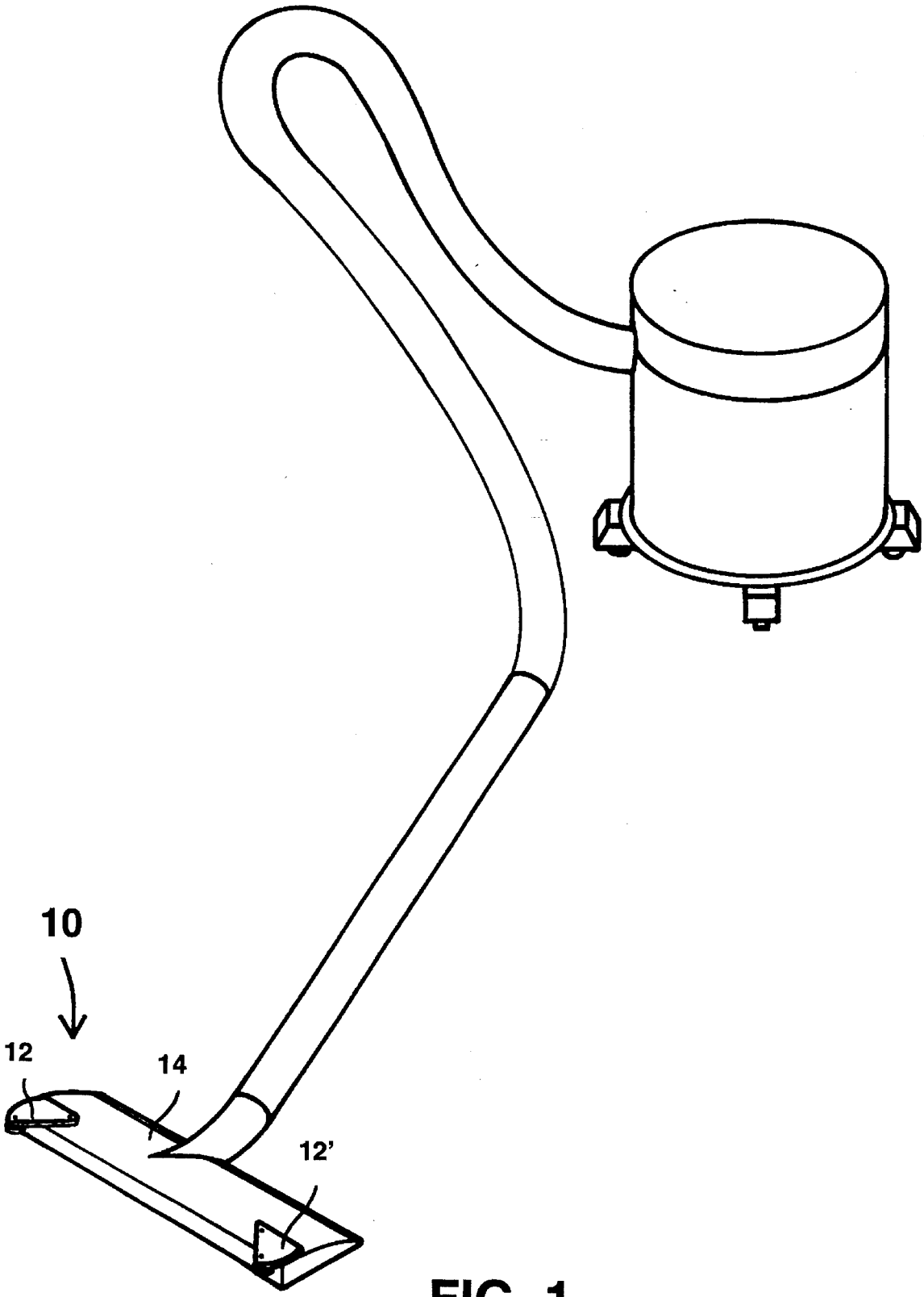
FIG. 1 is a perspective view of a canister-style vacuum cleaner with one embodiment of the invented bumper system.
Figure 2A:
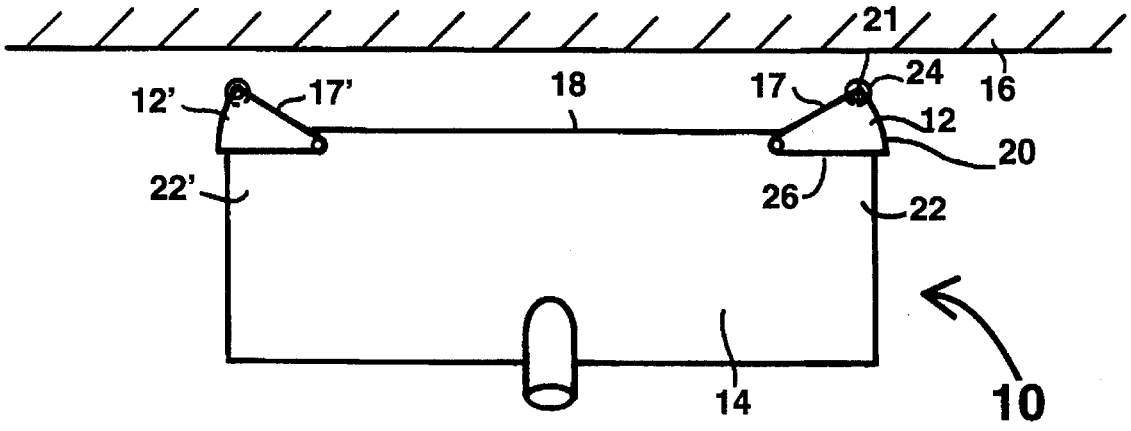
FIG. 2A is a schematic top view of the vacuum cleaner head and bumper system of FIG. 1, approaching but not touching a wall.

The circle-sector-shaped member, herein called "sector" 12 or "sector member", of the preferred embodiment is biased so that it resiliently pivots out of the way, thus retracting or "hiding" into the equipment head 14 when it hits an obstacle 16 head-on, as shown in FIGS. 2A and B. The sector 12 retracts so that its front edge 17 is generally parallel to the horizontal extent, that is, the outer perimeter edge 18, of the equipment head. 14. While allowing the sector 12 to retract, the spring 19 or other biasing means preferably exerts enough outward force on the sector 12 to cushion the impact of the equipment head 14 against the obstacle 16.

Figure 4A:
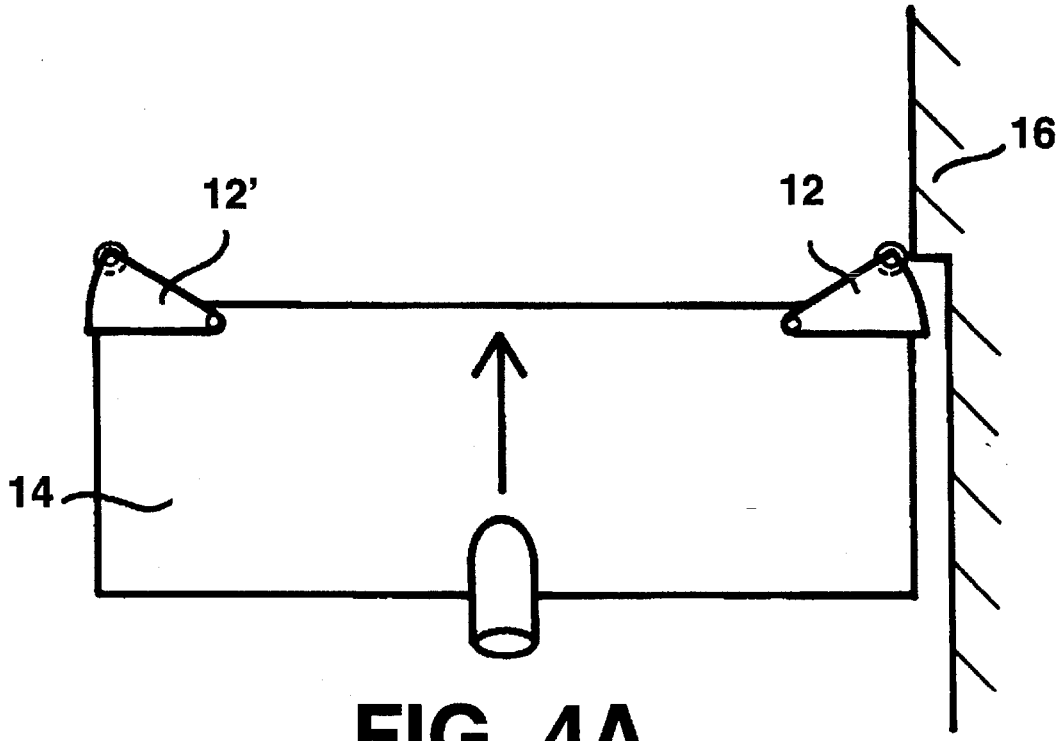
FIG. 4A is a schematic top view of the embodiment of FIG. 2A, approaching but not touching a woodwork corner.
Figure 4B:
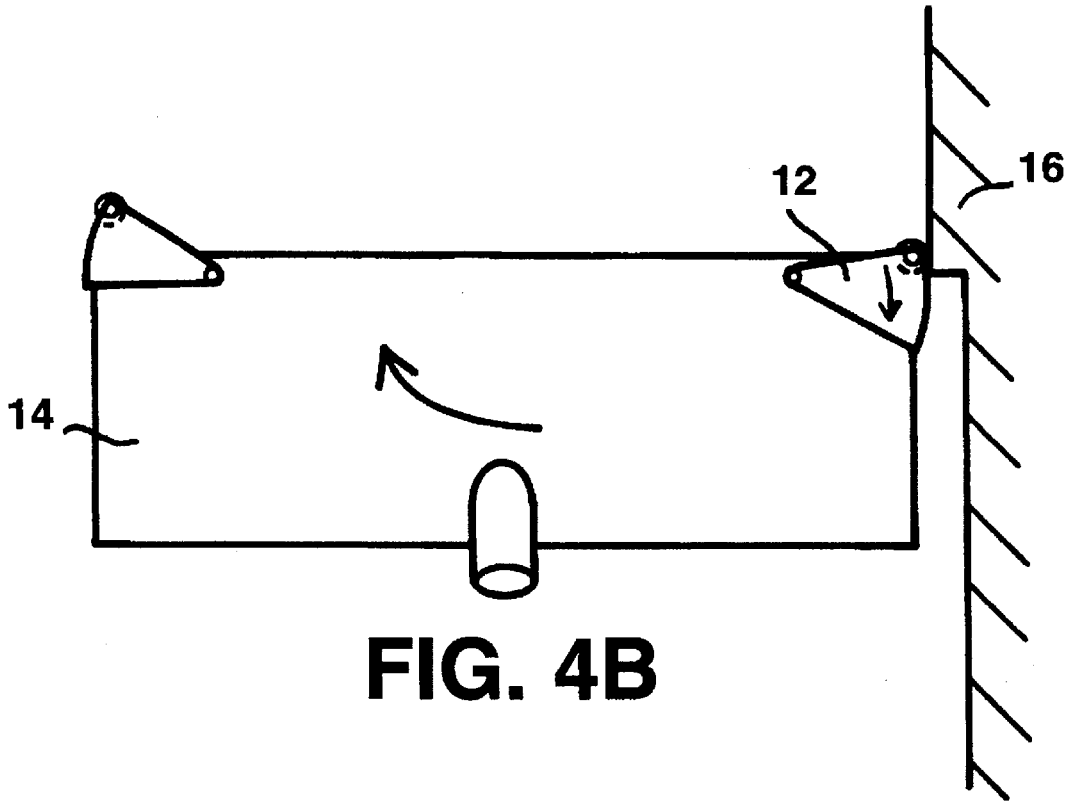
FIG. 4B is a schematic top view of the embodiment of FIG. 4A, in a side-impact with the corner.

When the equipment head 14 runs into a wall corner or door frame, for example, the sector 12 often hits the obstacle 16 "on the side" (that is, on the arc-edge 20 of the sector 12), rather than "head-on" (that is, on the front-most part of the sector 12, which is the corner 21). In such a side-impact, the arc-edge 20 of the sector 12 contacts the obstacle 16 and the sector 12 pivots inward and, thus, urges the equipment head 14 to the side, away from and around the obstacle 16, as shown in FIGS. 4A and B. Thus, when hit on the side, the sector 12, and in effect the corner 22 of the equipment head 14, "pivot" around the obstacle 16 instead of getting wedged against it. This "pivoting" of the head 14 results from the net result of the force of the head 14 being pushed forward and the sideways forces resulting from the obstacle impacting the sector 12.

The bumper member also includes a roller 24 connected to the front edge 17 of the sector 12 for rolling along an obstacle 16 surface, for example, when the user is trying to move the equipment head 14 sideways along a wall.

Thus, the circle-sector bumper system 10 provides the retracting, pivoting or rotating, and rolling functions of the instant invention.

Two sectors 12, 12' are preferably mounted at the front corners 22, 22' of the equipment head 14. The generally flat front edge 17, 17' of each sector 12, 12', when the sector 12, 12' has retracted, is generally parallel to and is flush with or extends only slightly out beyond the perimeter edge 18 of the equipment head 14. Each arc-edge 20 preferably, but not necessarily, represents about a 45–65 degree sector of a circle, which extends to be about even with, or protrudes slightly out from, the corners 22, 22' of the equipment head 14. The back edge 26 of the sector 12 is preferably generally flat, but may be other shapes, for example, as required by various biasing designs or to fit onto various styles of equipment heads. The sector 12 preferably has generally flat upper and lower surfaces 28, 30 and is designed to be a thickness appropriate for the strength of the material chosen and for the individual designs of equipment heads.

Figure 2B:
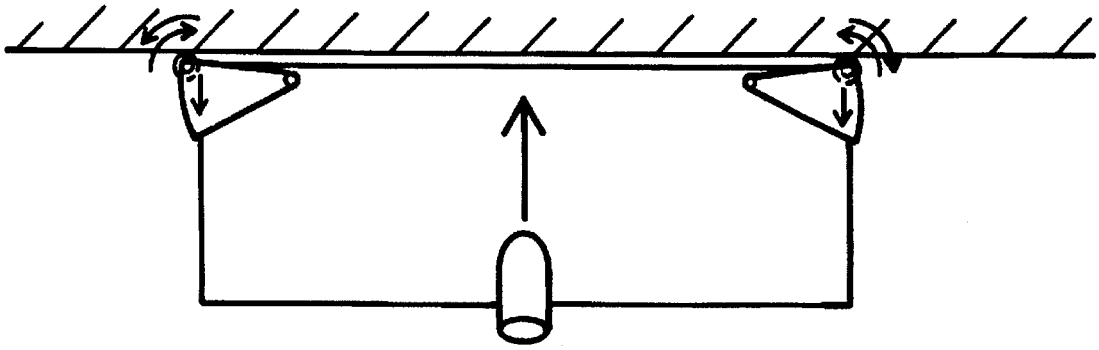
FIG. 2B is a schematic top view of the embodiment of FIG. 2A, with the vacuum cleaner head in head-on impact with the wall.
Figure 3:
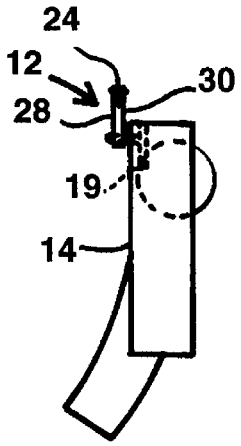
FIG. 3 is a schematic right side view of the embodiment of FIG. 2A.

The roller 24 is preferably a small wheel rotatably mounted near the front corner 21 of the sector 12, so that the wheel is horizontally-disposed and generally parallel to the floor. The roller 24 is mounted so that is freely spins to either side. The front corner 21 is the forward-most portion of the sector bumper system and, therefore, the roller 24 typically contacts the obstacle first in a head-on impact. Upon head-on impact, the roller 24 transfers force to the sector 12 to retract the sector 12. During the head-on impact, the rollers 24, 24' spin slightly toward the inside, as shown in FIG. 2B, to roll along the obstacle as the sectors 12, 12' retract. The roller is able to spin freely, when the sector 12 is in the extended or the retracted positions, to help ease the movement of the equipment along a wall or obstacle surface.

Circular Design

Figure 5A:
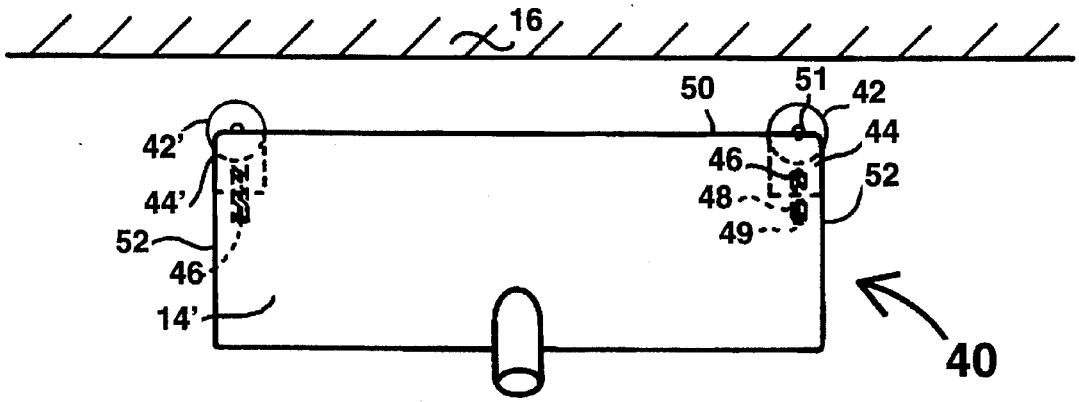
FIG. 5A is a schematic top view of another embodiment of the invented bumper system approaching but not touching a wall.
Figure 5B:
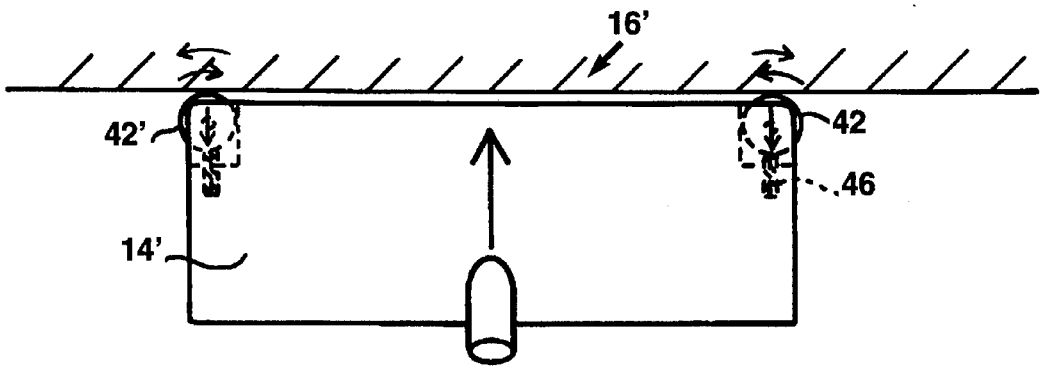
FIG. 5B is a schematic top view of the embodiment of FIG. 5A, in head-on impact with the wall.
Figure 5C:
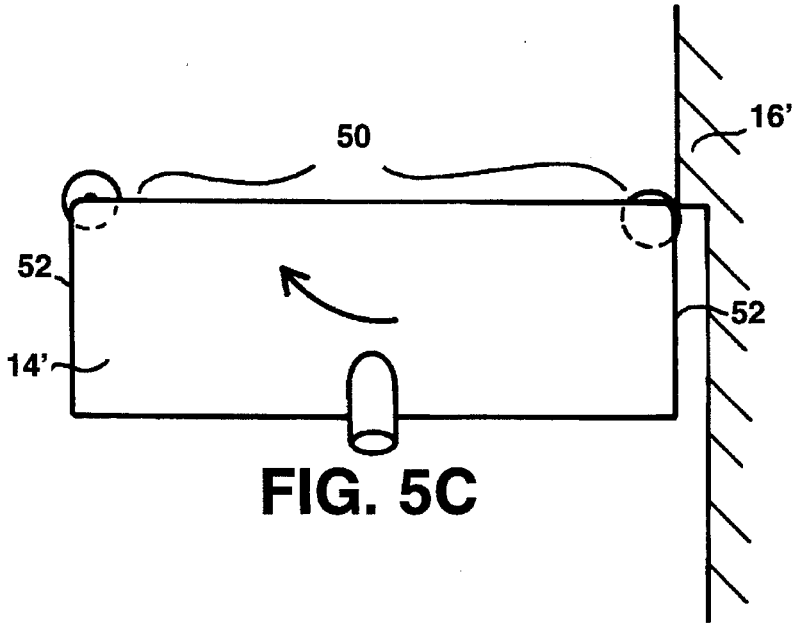
FIG. 5C is a schematic top view of the embodiment of FIG. 5A, in side-impact with a woodwork corner.

The alternative embodiment of bumper system 40 that is shown in FIGS. 5A–C, includes a bumper member that is circular in shape. The circular member 42 is rotatably mounted on the equipment head 14', preferably near a corner 44 of the head. The circular member 42 is also biased with a spring 46 or other biasing means in a channel 48 or other guide means so that, when the equipment head 14' hits an obstacle 16' head-on, as shown in FIG. 5B, the circular member 42 may retract back into the head 14' to allow the head 14' to reach close to the edge of the carpet or floor. The spring 46 or other biasing means exerts enough force on the circular member 42 to make the retracting circular member 42 act as a cushioning function. The channel 48 has a barrier end 49 for retaining the spring 46 in the channel 48 as the spring 46 pushed on the circular member 42. Preferably, the circular member 42 is a wheel which has axle 51 that is received in the channel 48 and is contacted by the spring 46 for biasing the wheel out from the equipment head 14'.

When the circular member 42 hits an obstacle 16' to one side, rather than head-on, the circular member 42 rotates to the side, urging the equipment head 14' away from and around the obstacle 16', as shown in FIG. 5C. The spring 46 and the channel 48 are designed so that the circular member 42 stays in the extended position, rather than retracting, when hit on the side, and the circular member 42, and in effect the equipment head 14', "roll" around the obstacle 16' instead of getting wedged against it. To act as a retention means, the spring 46 may be designed to be of such a strength or design that only a head-on impact will compress it significantly, while a side-impact will not. A side-impact, in the case of the circular member 42, is when the circular member 42 hits the obstacle 16' at preferably more than about 10 degrees to the side from the exact front of the circular member 42. The spring 46 and channel 48 act together, therefore, both as a retraction means to let the circular member 42 resiliently retract but also as a retention means to prevent the circular member 42 from retracting during side-impact.

Figure 6C:
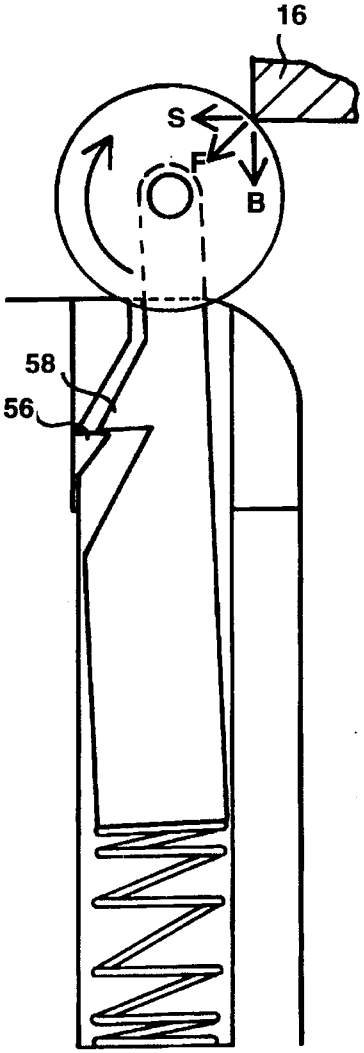
FIG. 6C is a schematic top view of the embodiment of FIG. 6A, with the catch member protrusion received in the channel notch during a side-impact.
Figure 6B:
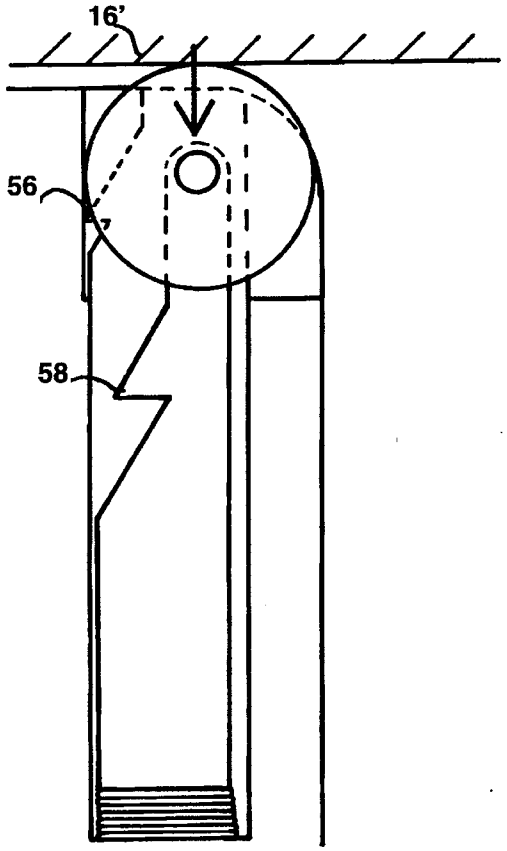
FIG. 6B is a schematic top view of the embodiment of FIG. 6A, retracted during a head-on impact.
Figure 6A:
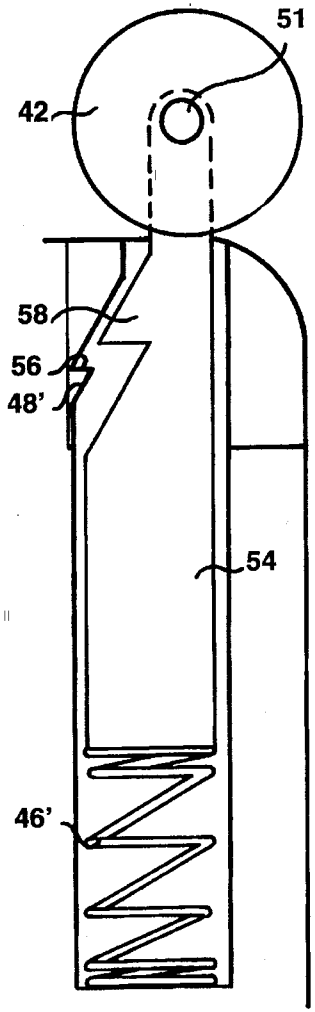
FIG. 6A is a schematic top view of a detail of another embodiment of the invention, with a circular member in extended position.

Alternatively, the preferred spring 46' and channel 48' embodiment, shown in FIGS. 6A–C, act as a retention means because of a catch member 54 and notch 56 system. The circular member 42 is rotatably connected to the catch member 54, which has a protrusion 58 that catches securely in the recess or "notch" 56 in the side wall of the channel 48' during a side-impact. As shown in FIG. 6A and B, before and during a head-on impact, the wheel (42) and catch member 54 slide forward and backward (out and in) without engaging in the channel notch 56. During side-impact, shown in FIG. 6C, the force F on the wheel (42) may be divided into a backwards force vector B and a sideways force vector S. Force S results in the catch member moving sideways so that the protrusion engages and lodges in the notch 56 to prevent the force B from moving the catch member 54 and wheel (42) into a retracted position.

Rotation of the circular member 42 also provides the rolling function, when in either the extended or retracted position, to allow the equipment head to be more easily moved along a wall, for example.

Thus, the circular member bumper system 40 provides the retracting, pivoting or rotating, and rolling functions of the instant invention.

Preferably, two circular members 42, 42' are mounted to the extend horizontally past the horizontal extent of the equipment head, that is, slightly out past the front edge 50 of the outer perimeter edge of the head head 14' when retracted to still provide the rolling function when retracted. Preferably the circular members 42, 42' extend slightly out past the side edge 52 both when extended and retracted. "Slightly" in this context is preferably, but not necessarily, about 1/16–½ inch, in order to allow the equipment head to reach close to the floor edge.

Preferably each circular member 42 is a horizontally-disposed wheel mounted at its center, so that it is generally parallel to the floor or carpet surface. The wheel should be large enough in diameter to extend substantially across the corner 44 of the equipment head to provide an effective rotation function to smoothly maneuver the head around obstacles. Optionally, the circular member 42 may be a cylinder, for example, if the length of a cylinder can be accommodated for retraction into an equipment head.

Optionally, the bumper members may be made of or covered with a soft or slightly cushioning material to further prevent damage to the wall, woodwork, or other obstacle. The material or covering, however, should not be so resilient or soft that it prevents the rotation or pivoting function from pushing or urging the equipment head around the obstacle. Preferably, the sector 12 and the circular member 42 are a durable and crack-resistant plastic or metal, for example. A durable and non-marring covering may be attached to the outer edge of the roller 24 and the circular member 42 for frequent and non-marking contact with walls and obstacles.

The bumper members typically are mounted on top of the equipment head, to prevent interference with the cleaning or other maintenance function of the equipment head. However, some designs may have bumper members mounted inside the casing of the equipment head, for example. Thus, the term "retract into the head" or "hide into the head" means that the bumper member retracts to be closer in to the equipment head, in other words generally toward the center of the head and behind the outer perimeter edge of the head, but not necessarily that the bumper member actually retracts inside the head casing or head enclosure. Thus, the bumper member may retract to lie substantially on top of the head, for example, extending only slightly beyond the front and side edges of the head.

The term "equipment head" refers to any piece of equipment used for floor or building surface maintenance, in particular, vacuum cleaner suction heads or canisters, upright-style vacuum cleaners, shampooers, waxers, etc., which are likely to contact walls, furniture, woodwork, etc.. The figures illustrate bumper systems 10, 40 mounted on the front of equipment heads, but alternatively, the bumper systems may be mounted on sides on the back or sides of floor maintenance equipment. For example, bumper members may be installed in several locations around a vacuum cleaner canister that typically impacts on several of its sides against walls and furniture.

Although this invention has been described above with reference to particular means, materials, dimensions, and embodiments, it is to be understood that the invention is not limited to these disclosed particulars, but extends instead to all equivalents within the scope of the following claims.

I claim:

1. A floor maintenance equipment bumper system for making smoother and easier the movement of the floor maintenance equipment around and along an obstacle, the bumper system comprising:

a floor maintenance equipment head, a bumper member connected to the equipment head and extending horizontally out from the equipment head for impacting the obstacle, a retraction means for allowing the bumper member to resiliently retract into the equipment head, upon head-on impact of the bumper member with the obstacle, and a pivot means for pivoting the bumper member, upon a side impact of the bumper member on the obstacle, to urge the equipment head away from and around the obstacle.

2. A floor maintenance equipment bumper system for making smoother and easier the movement of the floor maintenance equipment around and along an obstacle, the bumper system comprising:

a floor maintenance equipment head having a horizontal extent, a bumper member connected to the equipment head and extending out from the equipment head for impacting the obstacle, the bumper member comprising:

a sector member having a point end and an opposing arc-edge, and a front edge and an opposing back edge, wherein the sector member lies generally horizontally and is pivotally connected near the point end to the equipment head so that the sector member pivots to extend horizontally out from the equipment head and, upon head-on impact of the sector member on the obstacle, the sector member pivots into the equipment head, so that the sector member front edge is generally parallel to the said equipment head horizontal extent, a retraction means for allowing the sector member to resiliently retract into the equipment head, upon head-on impact of the bumper member with the obstacle, and a horizontally-disposed roller rotationally connected to the sector member and extending out from the sector member front edge for rolling along the obstacle.

3. A floor maintenance equipment bumper system as set forth in claim 2, wherein the sector member front edge and the arc-edge join to form a corner, and wherein the roller is connected to the sector member near the said corner.

4. A floor maintenance equipment bumper system as set forth in claim 2, wherein the equipment head horizontal extent has two opposing front corners and a bumper member is pivotally connected to the equipment head near each of the said front corners.

5. A floor maintenance equipment bumper system as set forth in claim 2, wherein the biasing means comprises a spring.

6. A floor maintenance equipment bumper system for making smoother and easier the movement of the floor maintenance equipment around and along an obstacle, the bumper system comprising:

a floor maintenance equipment head, a bumper member connected to the equipment head and extending out from the equipment head for impacting the obstacle, the bumper member comprising:

a circular member rotatably connected to the equipment head and horizontally-disposed, a retraction means allowing the circular member to resiliently retract into the equipment head, upon head-on impact of the circular member against the obstacle, and a retention means for preventing the circular member from retracting when the circular member impacts on a side with an obstacle, but allowing the circular member to rotate upon side-impact to urge the equipment head away from the obstacle.

7. A floor maintenance equipment bumper system as set forth in claim 6, wherein the circular member is a horizontally-disposed wheel.

8. A floor maintenance equipment bumper system as set forth in claim 7, wherein the wheel has an axle and wherein the retraction means and retention means comprise:

a horizontal channel having a barrier end and receiving the wheel axle, a spring received in the channel between the barrier end and the wheel axle and pushing on the wheel axle to resiliently bias the wheel out from the equipment head.

9. A floor maintenance equipment bumper system as set forth in claim 8, further comprising:

a catch member having a protrusion, the catch member rotatably connected to the wheel axle and lying in the channel between the spring and the wheel axle, and wherein the channel has a side wall having a recess that receives the catch member protrusion during side-impact of the wheel on the obstacle to prevent the wheel from retracting, and wherein, during a head-on impact, the recess does not receive the protrusion and does allow the wheel to retract.

10. A floor maintenance equipment bumper system as set forth in claim 1, further comprising a rolling means, attached to the bumper member, for allowing the bumper member to roll along the obstacle.

11. A floor maintenance equipment bumper system for making smoother and easier the movement of the floor maintenance equipment around and along an obstacle, the bumper system comprising:

a floor maintenance equipment head, a bumper member connected to the equipment head and extending horizontally out from the equipment head for impacting the obstacle, a retraction means for allowing the bumper member to resiliently retract into the equipment head, upon head-on impact of the bumper member with the obstacle, and a rotating means for rotating the bumper member, upon a side impact of the bumper member on the obstacle, to urge the equipment head away from and around the obstacle.

* * * * *